US005099668A

United States Patent [19]

Spath

[11] Patent Number: 5,099,668

[45] Date of Patent: Mar. 31, 1992

[54] UNIVERSAL PLYING IRON

[76] Inventor: Walter E. Spath, Bordwaldstrasse 14, D-7760 Radolfzell 15-Güttingen, Fed. Rep. of Germany

[21] Appl. No.: 523,435

[22] Filed: May 15, 1990

[30] Foreign Application Priority Data

May 16, 1989 [DE] Fed. Rep. of Germany ..... 3915855

[51] Int. Cl.[5] ..... B21D 7/06

[52] U.S. Cl. ..... 72/296; 72/413; 72/478; 72/482

[58] Field of Search ..... 72/295, 296, 301, 302, 72/413, 478, 481, 482

[56] References Cited

U.S. PATENT DOCUMENTS

| | | | |
|---|---|---|---|
| 337,113 | 3/1886 | Bailey | 72/413 |
| 504,628 | 9/1893 | Senger | 72/413 |
| 2,533,470 | 12/1950 | Kapelis | 72/478 |
| 2,714,916 | 8/1955 | Green | 72/295 |
| 3,033,266 | 5/1962 | Leckner | 72/296 |
| 3,181,331 | 5/1965 | Wishing | 72/478 |
| 3,426,569 | 2/1969 | Braver et al. | 72/295 |
| 4,548,065 | 10/1985 | Vyhnal | 72/413 |

*Primary Examiner*—Lowell A. Larson
*Assistant Examiner*—Thomas C. Schoeffler
*Attorney, Agent, or Firm*—Fleit, Jacobson, Cohn, Price, Holman & Stern

[57] ABSTRACT

A universal plying iron is described, consisting of a base plate with a mold support positioned on bracket supports in such a way as to match the contour and mold level of the section to be bent on the base plate, the section to be bent, in the form of a bending template, being bent by means of mold rollers around a section support projecting from the mold support. For the universal application of the plying iron, without the need for involved modification of the bending molds, the bracket supports are positioned in adjustable fashion on the base plate and tension elements are provided on the bracket supports, which tension elements stress the mold support and simultaneously carry the section support, and can be adjusted to the desired height.

16 Claims, 7 Drawing Sheets

UNIVERSAL PLYING IRON

Figure 1:
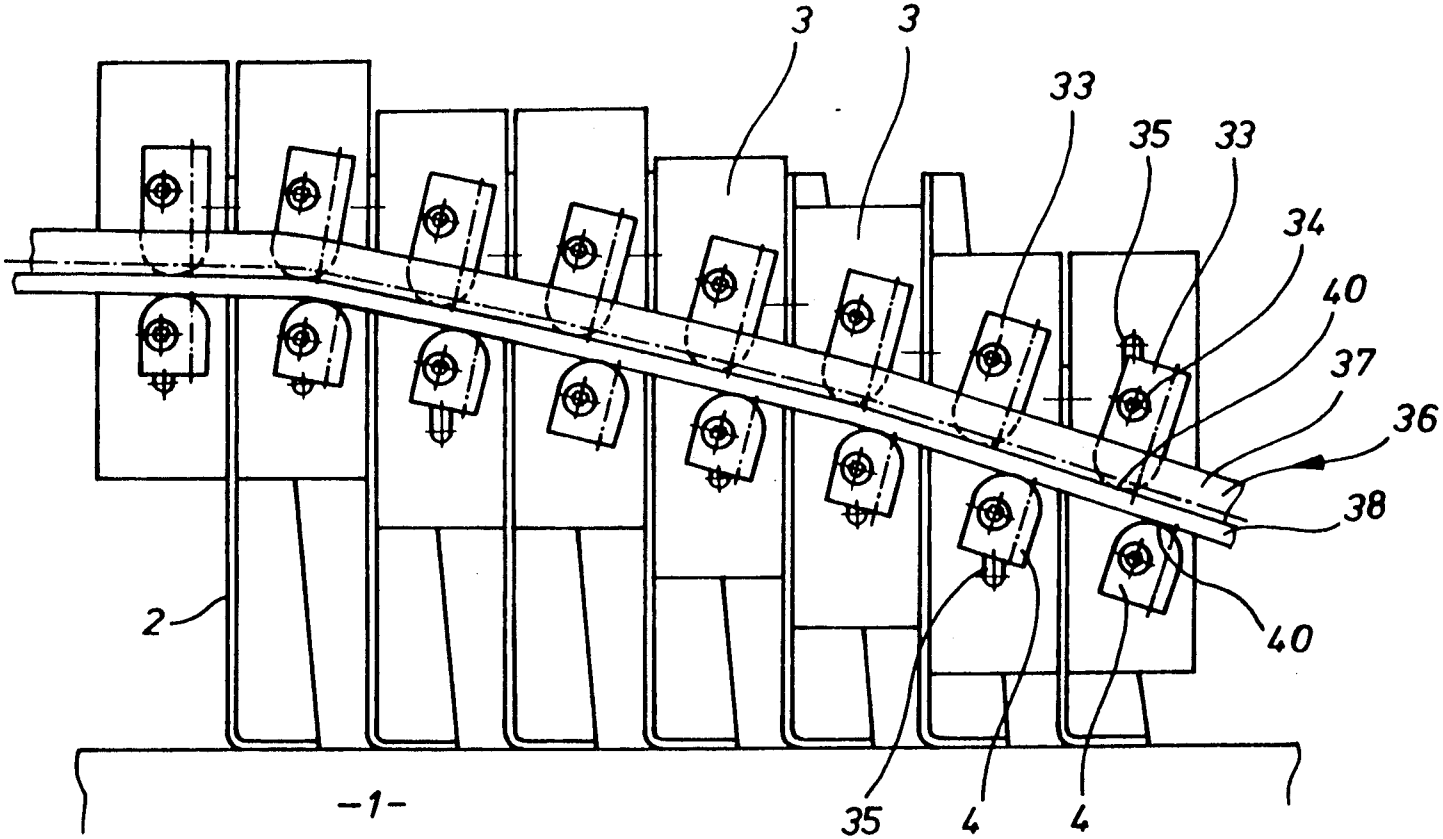

A universal plying iron is described, consisting of a base plate with a mold support positioned on bracket supports in such a way as to match the contour and mold level of the section to be bent on the base plate, the section to be bent, in the form of a bending template, being bent by means of mold rollers around a section support projecting from the mold support.

Plying irons of this type are employed in the bending of metal sections, the section to be bent being around a bending template on a plying iron. The plying iron itself basically consists of a base plate onto which triangular bracket supports are welded; the bracket supports bear a mold support which runs vertical to the base plate; furthermore, the bending template itself, in the form of a section support, is secured to the mold support by means of welding or some other means of attachment.

The disadvantage of this kind of plying irons is that they basically can only be used once for a given piece of bending work. If another section is to be bent, another plying iron must be employed.

Furthermore, this kind of plying iron can be modified only with difficulty, since if corrections are necessary the bending template attached to the support plate must be separated with shears and the new bending template must be re-welded after the corrections have been applied.

The present invention is therefore based on the problem of elaborating a plying iron of the type initially described in such a way that it can be universally applied for bending work, without the need for involved modification of the entire tool when a new bending template is used.

The solution to this problem provides for the application of adjustable bracket supports to the base plate and of tension elements to the bracket supports which stress the mold supports and simultaneously carry the section supports, while being adjustable to the desired height.

According to the invention, then, a universally applicable plying iron is created in that several individual bracket supports in parallel arrangement and adjustable relative to each other are positioned on a base plate, with tension elements which support the bending template being positioned at each bracket support. The section for bending is bent by means of the bending template. The bending process here is performed in the form of stretch-bending, whereby a straight section bar under tensile stress and high pressure, e.g. produced by bending rollers, is drawn over the bending template. In addition to this stretch-bending, there is also roller stretch-bending and the like. These kinds of bending processes are described in detail in the older U.S. Pat. Nos. 4,674,165 and 4,941,338 of the present inventor. Reference is made to the disclosure there. That disclosure is to be encompassed in its entirety by the present invention.

According to the invention, tension elements which define support surfaces are then positioned on the mold supports, the tension elements being positioned on the mold supports in facing fashion and such that between them an interstitial area is defined in which the bending template is stressed. The support surfaces of the tension elements on the upper and lower side are then supported on the upper and lower sides of the bending template and thereby fix in position the bending template in all three spatial directions.

It is of significance that the tension elements ae held in easily adjustable fashion to the mold supports and thereby permit the bending template to be so positioned that it precisely accommodate the described bend of the section. When the bending template is thus positioned, the tension elements are braced so as to fix the bending template in place.

This bracing occurs in such a way that when the tension elements are first rotated, while the support surface rests on the bending template eccentric to the pivot of the tension element on the mold support, so that when these tension elements are turned on the bending template, an additional pressure force is exerted on the bending template. Bracing of the tension elements with the bending template then occurs in each case by means of a screw which passes through a longitudinal bore in the upper tension element, which crosses a bore in the bending template flush with the former bore, and which grips through a corresponding flush bore in the lower tension elements. The two tension elements positioned one above the other are thus connected with the bending template by means of common screw which passes through all three parts.

In a different embodiment the tension elements are formed as bundle-like, layered sheets which slide relative to each other.

These tension elements are designated in a general way as mold supports. The mold supports are adjustably attached on a bracket support.

Thus the mold support defines a plane for the section to be bent.

The mold support can consist of one or several bundle-like, layered sheets which slide relative to each other and which can be contoured manually through sliding on the plane of the base plate.

Formerly it was necessary to separate the mold supports known to the prior art with shears, then re-contour and re-weld them.

This is no longer necessary under the invention and the mold supports can be manually contoured.

For their own part, these mold supports bear a synthetic support whose task is to interlock with the hollow section of the section to be bent and to receive the section. The synthetic support serves as a seat for the section and holds it in place.

In the case of sections which e.g. are to be bent at an angle of 60° toward each other, there is no penetrating section support; instead the section support is interrupted at the edges to be bent, and at this point a rotating part is inserted, i.e. a cylinder which on one side of its jacket surface is flush with one section support and on the other side of its jacket surface is flush with the other section support, both section supports being received by the section cylinder. Section cylinders of this type, which are connected with the section supports, thus permit any desired opened or closed bending angle.

It is important that the section support preferably consists of a synthetic material, thereby assuring easy deformation of the synthetic material.

It is of decisive importance that tension elements are present on the bracket supports which stress the mold supports and simultaneously bear the section supports and which can be adjusted to the desired height.

In this manner it is possible to slide the section support in the Z axis, thereby assuring spatial inflection in conjunction with bending in the X and Y axis.

The heart of the present invention thus rests in the fact that adjustable bracket supports are positioned on a base plate and the bracket supports are connected with tension elements which brace the mold supports and simultaneously carry the section supports.

This describes a largely universal plying iron, since with the adjustment of the bracket supports on the base plate the general bending contour can be selected and the practical application of the plying iron be performed as follows:

The desired bending mold, which can also be thoroughly three-dimensional or can also involve torsional bending, is first sketched out diagrammatically, and the bending template described here is fitted manually to the desired bending mold.

A sample section is then bent and compared with the demand bending form; the necessary corrections become apparent from the discrepancies.

In the past, manual corrections could only be performed with considerable expense, specifically by separating the section support and manually re-bending it and re-welding or otherwise re-attaching it; it was likewise necessary to separate the bracket support and re-weld it, or the like. Much welding, separating, correcting, and bending work, all known to the prior art, was thus necessary.

With the present invention, various possibilities of adjustment are afforded, which permit accommodation of a new bending template to the demand bending section in a matter of minutes.

In addition, adjustable fastenings between the bracket supports and the base plate are available, as are adjustable fastenings between the bracket supports and the mold support, and also the adjustable fastening between the section support and the mold supports.

Instead of the bundle-like arrangement of these mold supports, it is naturally also possible two employ only two metal sheets or only a single metal sheet.

This mold support thus has the sole task of creating a base surface for the section support resting upon it, which is then positioned in adjustable fashion on the mold support in the Z-plane.

The mold support thus has the sole task of producing the demand bending contour, the edge contour being produced—as initially mentioned—by the section cylinder.

The invention will not be described in greater detail on the basis of diagrams. Further features and advantages will emerge from the diagrams and their description.

Figure 2:
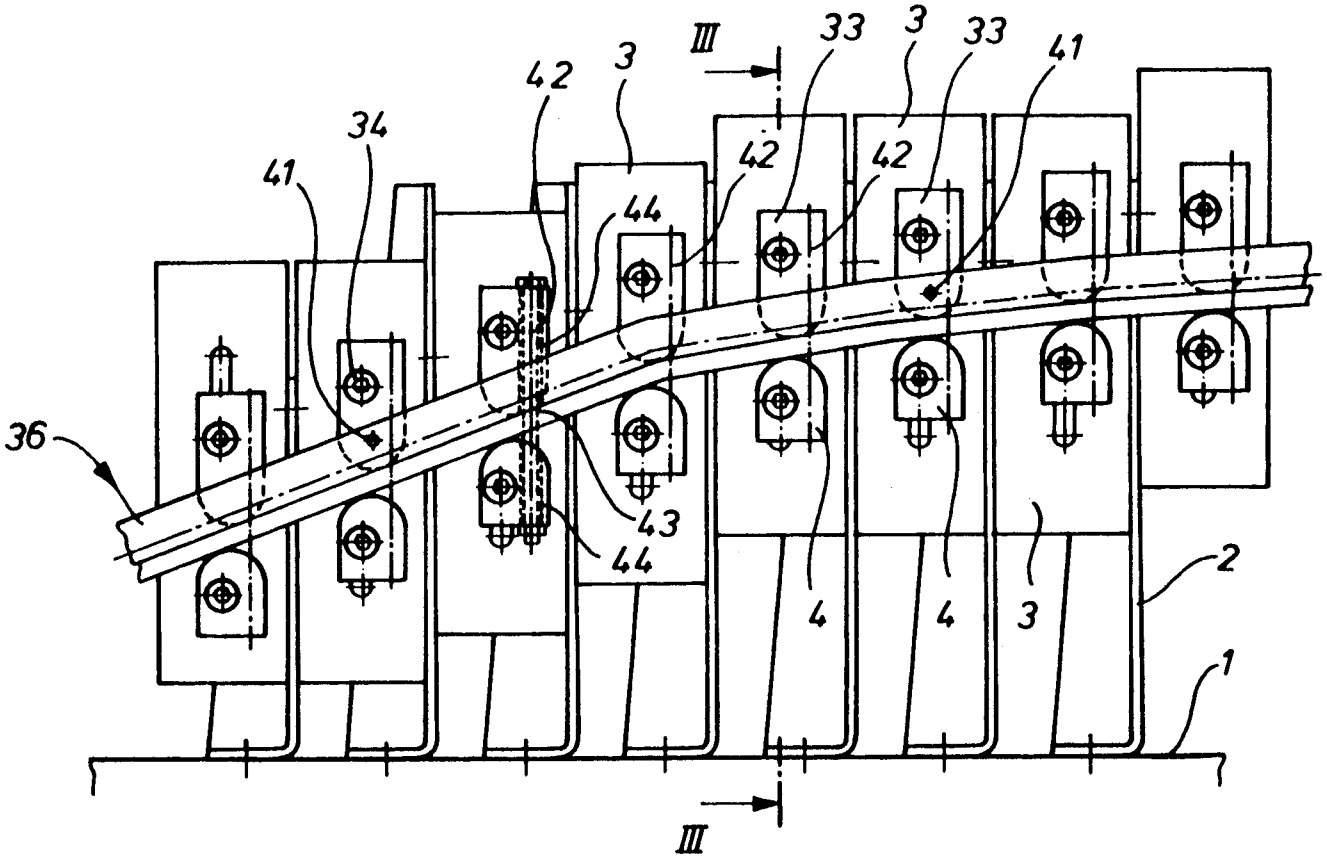

The diagrams show:

FIG. 1: side view of a plying iron according to the invention in an initial embodiment, with a bending template not yet fully fastened in place FIG. 2: the iron according to FIG. 1 with bending template fully fastened in operating position.

Figure 3:
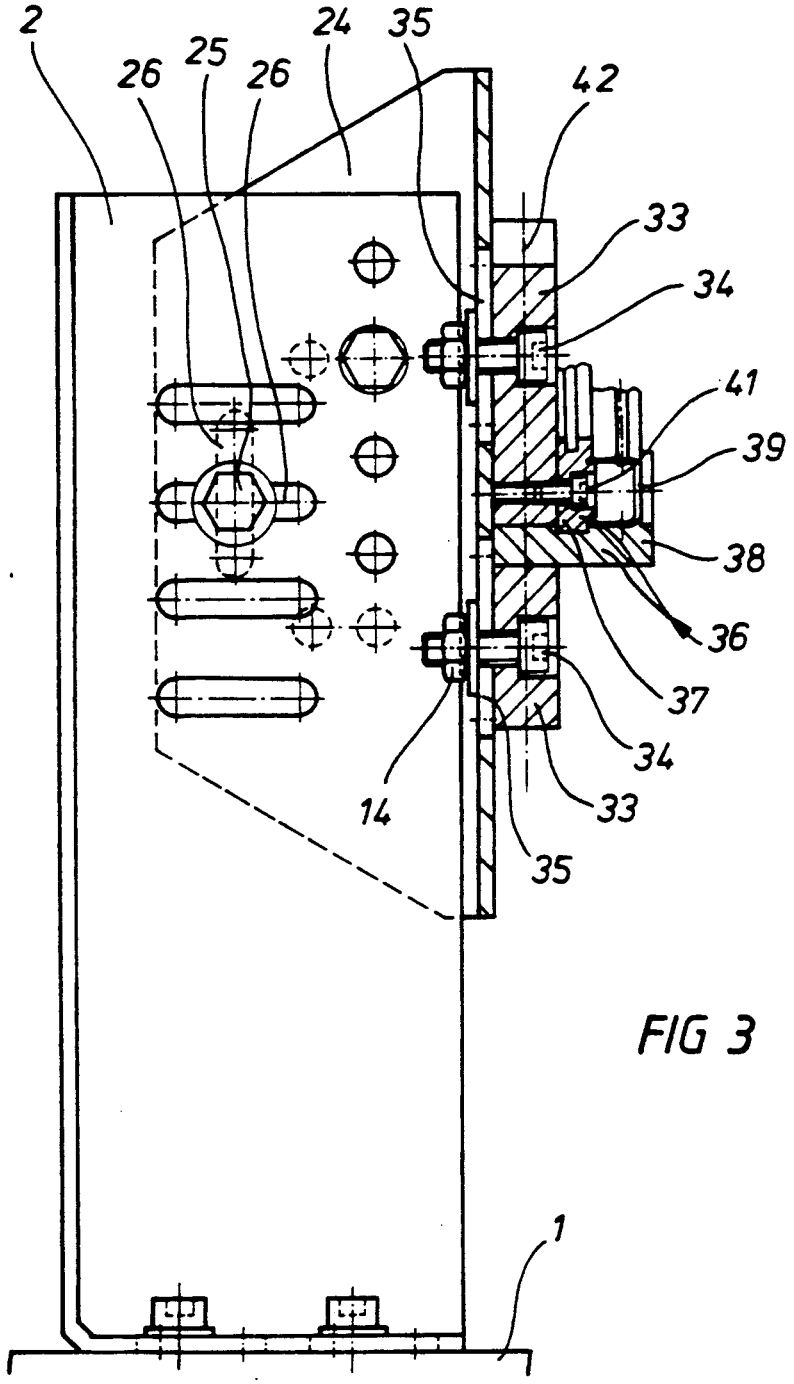

FIG. 3: section along line III—III in FIG. 2.

Figure 4:
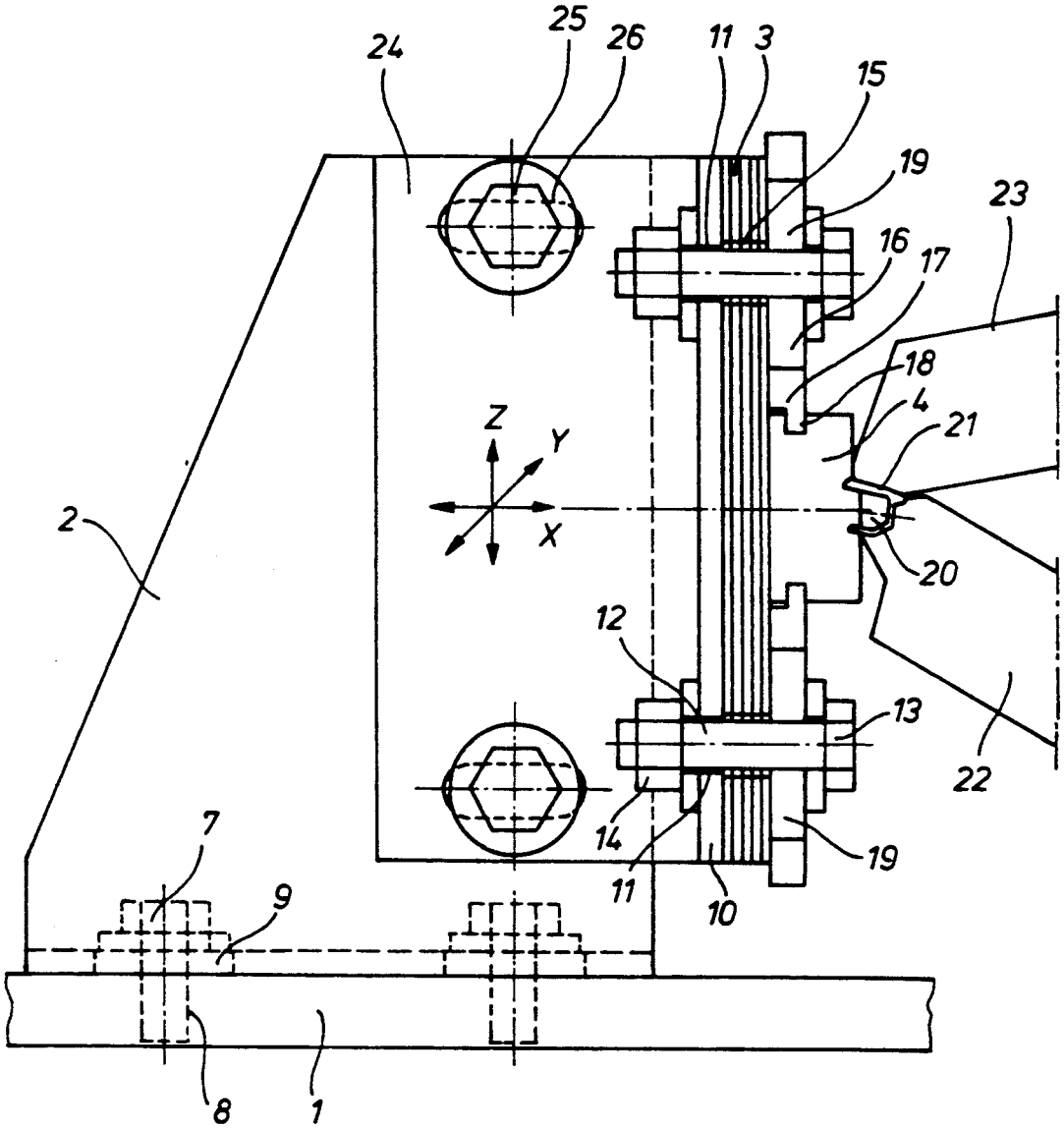

FIG. 4: side view of a plying iron in a second embodiment with bundle-like tension elements.

Figure 5:
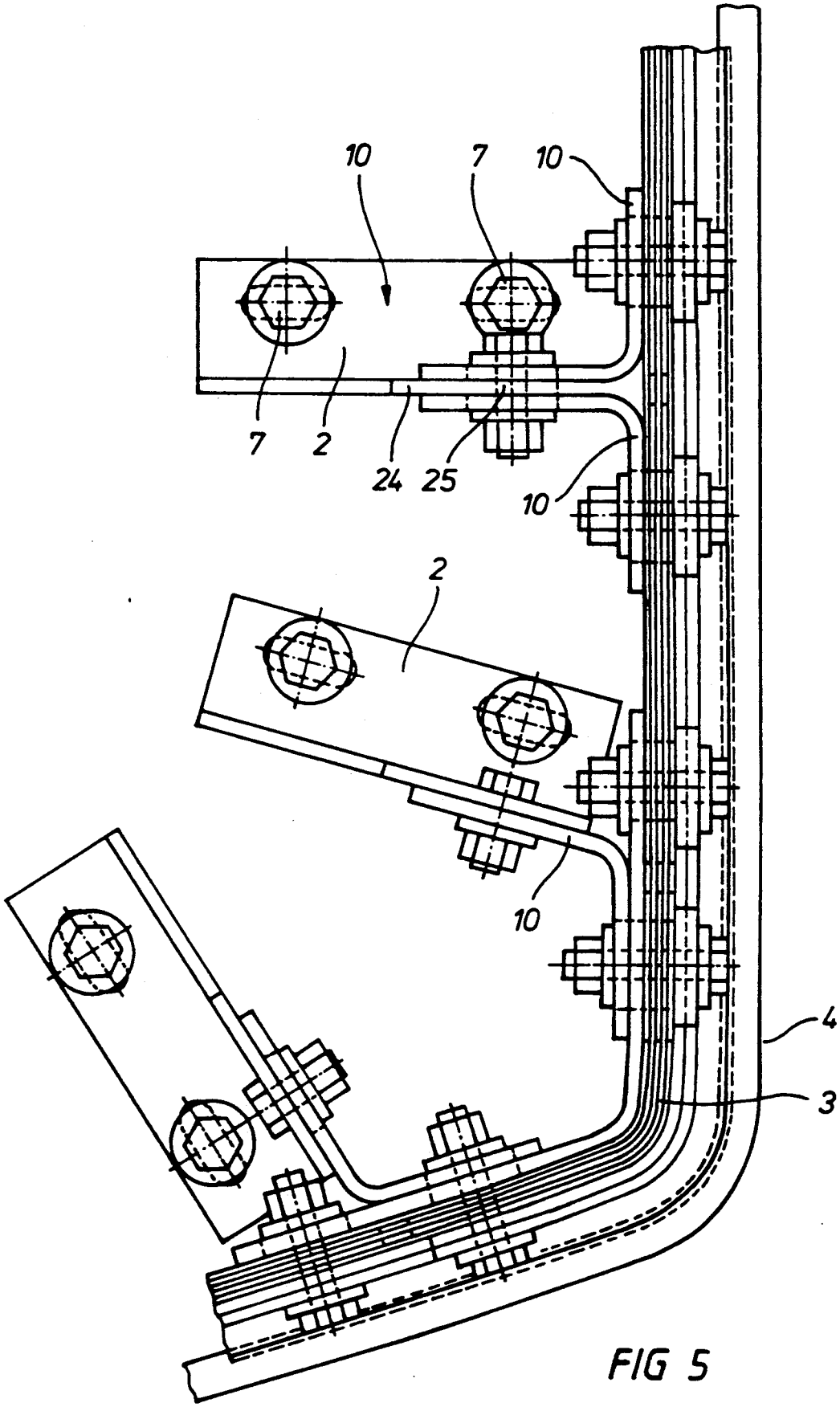

FIG. 5: top view of the iron according to FIG. 4.

Figure 6:
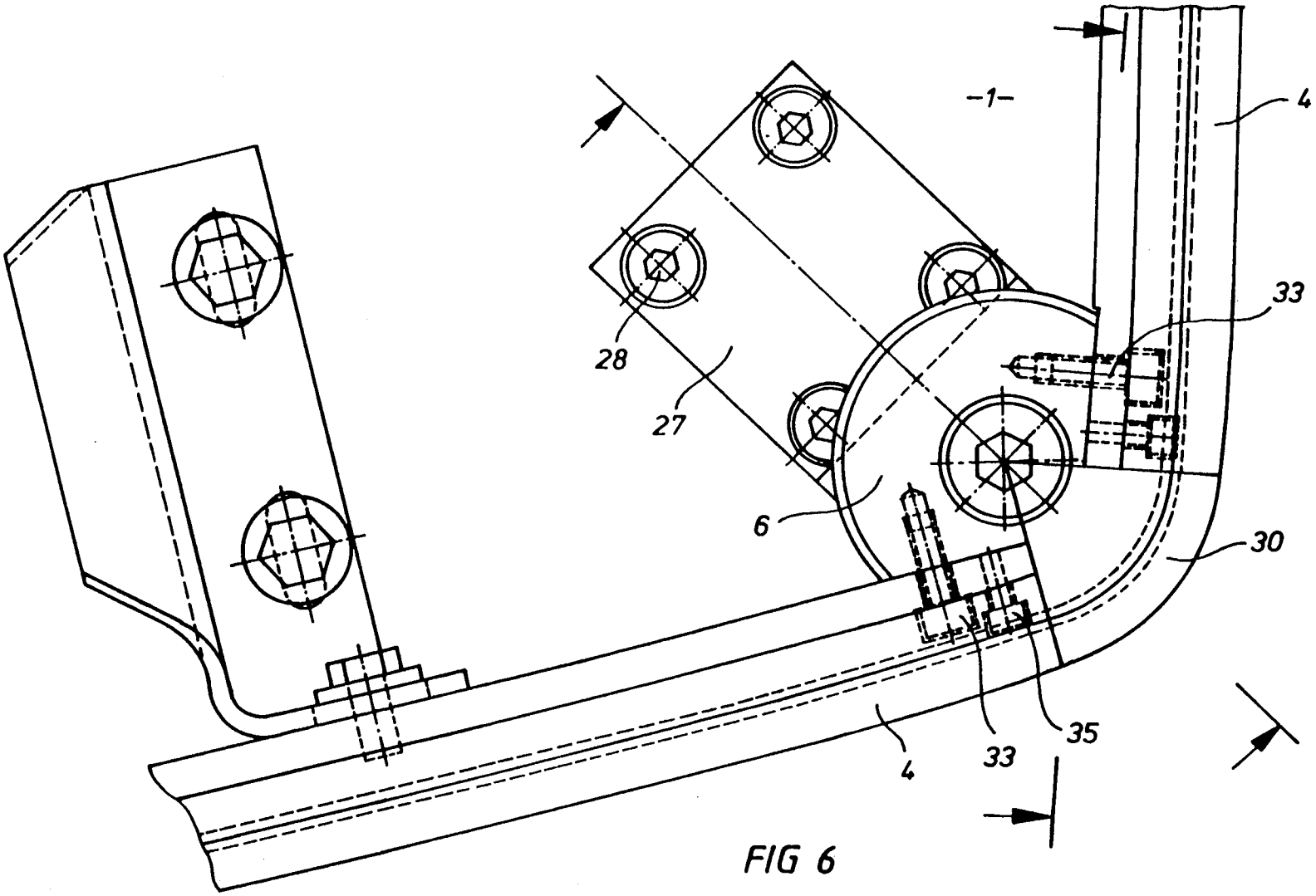

FIG. 6: a third embodiment of the plying iron according to the invention, in which a section cylinder is positioned on the edges of the bending template.

Figure 7:
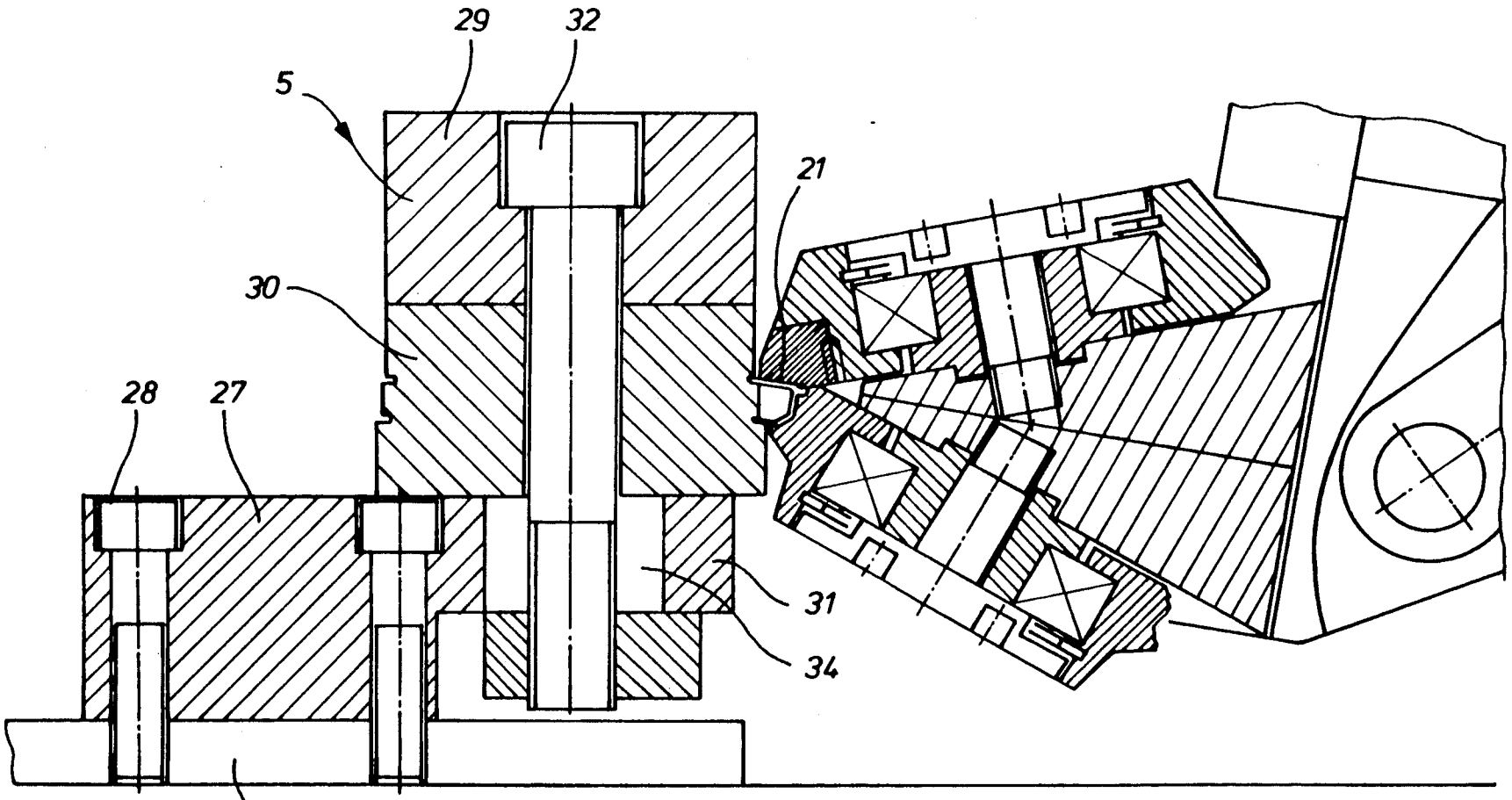

FIG. 7: the section cylinder according to FIG. 6 in section, with section rollers which rest against the section to be bent.

As shown in FIG. 1, bracket supports 2 on base plate 1 are adjustable on the plane of base plate 1. Each bracket support 2 carries two tension elements 33, one positioned above the other, which between them define an interstitial space. Each tension element 33 is adjustably attached by means of screws 34 in the area of the vertically extending elongated hole 35 in a mold support 3. The mold supports and bracket supports together define respective support assemblies.

The mold support 3 in turn is adjustably fastened to the bracket support 2 in two spatial axes perpendicular to each other.

The tension elements each define support surfaces 40 and thereby support a bending template 36, which consist of two parts in the depicted embodiment (see FIG. 3). Bending template 36 here consists of a vertical template 37 and a horizontal template 38. The two templates define a bending section 39, by means of which a section is bent by bending rollers suggested in FIG. 3 into the precise section form of the bending section 39.

The bending template 36 thus defines the position, rotation and inclination of the section for bending 39, while the bending section 39 itself defines the geometrical dimensions of the section to be bent.

In the position shown in FIG. 1 the tension elements 33 are still not braced in fixed position against the bending template 36. In this position it is possible (with tools) to freely bend the bending template 36 so that it precisely corresponds to the desired bending line. In FIG. 1 the bending template 36 is provisionally secured by the tension elements 33.

When the ultimate shape of the bending template has been determined, the tension elements are firmly secured to the bending template 36. This is achieved first by turning the tension elements 33 around their mounting points in crews 34, so that the rounded support surfaces 40 form a wedge against the corresponding surfaces of the bending template 36. This is possible because the support surface 30 is eccentrically positioned relative to the mounting of tension element 33 in screw 34.

When all tension elements 33 in FIG. 2 are braced against the bending template 36 as a result of rotation, a screw 42 is employed to connect all three parts (33 and 36). The screw 42 passes through the aligned longitudinal bores 44 and engages with the opposite tension elements 33, as well as passing through a bore 43 in the bending template 36.

The bores 43, 44 are subsequently produced by simple piercing of the tension elements aligned as in FIG. 2, after which the screw is passed through and screwed in. The result is a firm connection between the tension elements and the bending template 36.

Additional fastening of the bending template in a direction vertical to screw 42 is provided for in that a second screw 41, which in each case connects with a tension element 33, is screwed into the bending template 36.

This screw 41 is positioned e.g. at every fourth or fifth tension element 33.

Another embodiment of the inventive plying iron will now be described on the basis of FIGS. 4 and 5.

A number of bracket supports 2 are secured on a base plate 1, with screws 7 which engage with the base plate 1 through threaded bores 8. Elongated holes 9 are provided in the area of the bracket supports, allowing the bracket supports 2 to be moved along the base plate and fixed into position.

Each bracket support 2 displays a front panel 10 with several location holes 11. The screw bolt 12 of a mounting screw 13 penetrates each location hole 11, and a nut 14 is positioned on the back of the front panel 10. Parallel to the front panel 10, bundle-like mold supports 3 are furnished, which—as indicated before—define the bending shape. The mold supports 3 displays bores 15 which are penetrated by the threaded bolts 12.

The threaded bolts 12 support tension claws 16 which display fingers 17 which point to each other; the fingers 17 each engage with a corresponding groove 18 in a section support or template 4.

This permits the section support 4 to be moved in the Z direction, inasmuch as the tension claws 16 display elongated holes 19 aligned in the Z direction.

By loosening the screw connections 12, 13, 14 the tension claws 16 can thus be moved in the area of the elongated holes, which allows the section support 4 to be moved along the Z axis.

In the embodiment shown, the section support 4 display an external section 20, which engages with the internal section of the section 21 for bending.

Thus the section for bending is stabilized in the bending process.

Outside of the section for bending 21 there are section rollers 22, 23. In a preferred embodiment according to FIG. 4 the bracket supports 2 have two parts; the front panels 10 are not firmly attached to the bracket support; rather—as shown in FIG. 5—the front panels are adjustably attached to part 24 of the bracket support by means of the corresponding screw connections 25.

These screw connections 25 also run in the area of elongated holes 26, so that the front panels 10 can be moved both in the X direction parallel to the base plate 1, and with equal ease at an angle such that a suitable adjustment of the front panels 10 relative to the plane of the base plate 1 is permitted.

Thus an angled positioning of the section support 4 relative to the plane of the base plate is possible.

In a different embodiment shims are positioned in the contact area between the section support and the mold support positioned behind it; these shims likewise permit an angled plane of the section support relative to the base plate 1.

As shown in FIG. 5, the mold supports 3 extend continuously over the bending edges, i.e. run without interruption.

FIG. 6 shows a modified embodiment in which a section cylinder 5, which can also be adjusted, is positioned in the corner area.

Here the section cylinder 5 is positioned on a support plate 27 which is attached to the base plate 1 by means of screw connections 28. Elongated holes are positioned here as well, thereby assuring that the section cylinder 5 can be moved parallel to the plane of the base plate 1.

A section through the section cylinder 5 can be seen in FIG. 4.

The section cylinder 5 here preferably consists of three parts—a front panel 29, a section support 30, and a chuck 31; all parts are connected with the support plate 27 by means of a tension screw 32.

As shown in FIG. 7, the section to be bent is formed-fitted to the external circumference of the corresponding section support 30.

It is important that the two mold supports abutting in section cylinder 5 are secured to this section cylinder, specifically in such a way that the external contour of the mold support 3 is flush with the contour of the mold support 30 on the section support 4.

Here the corresponding screw connections 33 are provided.

It is also important that the tension screw 32 passes through a bore 34 in the shape of an elongated hole and engages with the support plate 27, in such a way that the entire structure, consisting of parts 29, 30, 31, can also be moved parallel to the base plate.

In FIG. 6 the other screw 35 serves to secure the section support, made of plastic, to the outer circumference of the section support, while screw connection 33 serves to attach the mold support 3 to the outer circumference of the section support.

The tool can also be adjustably positioned by means of an hydraulic or pneumatic cylinder, i.e. the geometry can be sensitively modified in areas with narrower or wider radii depending on the difference in batch, thereby allowing the section to maintain the intended dimensions despite a (new) other degree of strength. The tool is thereby assigned a spring support component; fine adjustment thus takes into account the differing material properties of different batches.

I claim:

1. Apparatus for use in bending an elongate workpiece lengthwise into a profiled form comprising a base, a plurality of support assemblies, first mounting means adjustably mounting the support assemblies on the base for adjustment in horizontal directions, a pair of vertically spaced pivotal tension elements on each support assembly for releasably locking from top and bottom onto a bending template for the workpiece, second mounting means for mounting the tension elements on the respective support assemblies in a vertically adjustable manner, an elongate pliable bending template for securing between the tension elements of the respective support assemblies to provide an elongate profile for the workpiece, and means for releasably locking the respective tension elements onto the template whereby the profile of the template can be adjusted in mutually perpendicular directions at each support assembly by adjustments to the respective mounting means.

2. Apparatus as claimed in claim 1 wherein the first mounting means adjustably mounts the respective support assemblies on the base for adjustment in two mutually perpendicular directions.

3. Apparatus as claimed in claim 1 wherein each support assembly comprises an upright bracket support on the base and a mold support on the bracket support, the tension elements being mounted on the mold support and wherein the first mounting means comprises for each support assembly first adjustable attachment means mounting the respective bracket support on the base for adjustment in one horizontal direction, and second adjustable attachment means mounting the respective mould support on the bracket support for adjustment in another horizontal direction.

4. Apparatus as claimed in claim 1 wherein each tension element has a rounded nose portion for locking onto the template.

5. Apparatus as claimed in claim 4 wherein the nose portion has a center of curvature offset from a pivot axis of the tension element.

6. Apparatus as claimed in claim 1 wherein the means for releasably locking the respective tension elements to the template comprises attachment elements for insertion into aligned aperatures in the template and the respective tension elements.

7. Apparatus as claimed in claim 6 wherein the attachment elements and aperatures include horizontal attachment elements and horizontal aperatures.

8. Apparatus as claimed in claim 6 wherein the attachment elements and aperatures include vertical attachment elements and vertical aperatures.

9. Apparatus as claimed in claim 1 which includes at least one flexible element extending between the respective support assemblies and connected between each support assembly and the respective tension elements to form a backing for the template.

10. Apparatus as claimed in claim 1 wherein the template comprises a profiled plastic body.

11. Apparatus as claimed in claim 1 wherein the second mounting means comprises elongate aperatures in the respective support assemblies and screw connectors for adjustably mounting the respective tension elements along the respective aperatures.

12. Apparatus as claimed in claim 1 wherein the respective tension elements have fingers for engaging grooves in the template.

13. Apparatus as claimed in claim 1 including shims for insertion between the template and the respective support assemblies so as to incline the template relative to the base.

14. Apparatus as claimed in claim 1 further including a section cylinder with a vertical axis on the base between respective support assemblies to provide a cylinder surface around which the template is bent and attachment means for releasably securing the template to the cylinder.

15. Apparatus as claimed in claim 14 wherein the cylinder is carried on a plate adjustably mounted on the base.

16. Apparatus as claimed in claim 15 wherein the cylinder comprises an upper part, a central part to which the template is attached and a lower part in the form of a chuck, said parts being connected to the plate by a vertical tension screw.

* * * * *